United States Patent [19]

Dye

[11] 3,955,645

[45] May 11, 1976

[54] TREE CLIMBING STAND AND LOOP

[76] Inventor: James E. Dye, P.O. Box 1664, Athens, Ga. 30601

[22] Filed: Dec. 4, 1974

[21] Appl. No.: 529,592

[52] U.S. Cl. ..... 182/135; 182/187
[51] Int. Cl.[2] ..... A63B 27/02; A47C 9/10
[58] Field of Search ..... 182/187, 188, 133, 134, 182/135, 136

[56] References Cited

UNITED STATES PATENTS

| | | | |
|---|---|---|---|
| 869,382 | 10/1907 | Newton | 182/9 |
| 2,991,842 | 7/1961 | Hardin | 182/187 |
| 3,419,108 | 12/1968 | Mobbs | 182/187 |
| 3,715,012 | 2/1973 | Perry | 182/214 |
| 3,856,111 | 12/1974 | Baker | 182/135 |

*Primary Examiner*—Reinaldo P. Machado
*Attorney, Agent, or Firm*—Cushman, Darby & Cushman

[57] ABSTRACT

The upper hand-held small climbing device is shimmied up the tree and then pivoted downwardly until it grips the tree. The standing platform is then shimmied up the tree by lifting the body with the feet underneath of the foot straps on the platform. This pivots the platform away from the tree so that the strap may be slipped up into a new position. When the platform is then pressed against the tree, it will be held in place so that the upper hand-held climbing gripper may then be pivoted upward to release and shimmied up the tree also.

The stand and loop are provided with steel straps which can be easily set for different diameter trees. The strap of the tree stand is provided with pins to retard sawing.

The user's toes fit under a bar and are held in place by elastic heel straps which also facilitate back-packing of the stand.

The front edge of the stand is provided with a compound concave notch for addressing trees of various girths.

A seat is provided which has few parts and folds out of the way when not in use.

7 Claims, 6 Drawing Figures

TREE CLIMBING STAND AND LOOP

BACKGROUND OF THE INVENTION

Deer hunters and other game hunters use climbing tree stands to position themselves part way up trees for move advantageous positions to spot their prey.

Sometimes a climbing tree stand is used alone, or with a safety belt, but the stand is most effectively used with a hand-held climbing gripper. The use of a safety belt is always recommended.

U.S. Pat. No. 3,485,320 to Jones, Dec. 23, 1969, illustrates a device for climbing a tree by this approximate method. In this patent, the upper framework is shimmied up the tree against the force of a series of elastic vertical straps attached between this frame and the lower platform. The framework is then pivoted against the tree to lock it in place and the weight of the person is supported on this upper framework with the feet being raised so that the elastic straps may pivot the lower platform away from the tree to release it and raise it up the tree. When the person then places his weight again on the bottom platform, this pivots the platform against the tree to lock it in place whereby the upper framework may then be raised by the person's hands to release it from the tree and shimmy it further up. A series of these actions will raise both the platform and the person up the tree to the selected position.

U.S. Pat. No. 3,419,108 to Mobbs, Dec. 31, 1968, is directed to a portable tree stand which is engaged into a tree and held in place by means of a series of spikes on the platform and its support as well as a tree encircling chain. The platform is provided with a folding seat. Spikes are provided on the platform to prevent the sawing action in a horizontal plane around the tree.

U.S. Pat. No. 2,392,538 to Knudsen, Jan. 8, 1946, and No. 2,842,300 to Johnson, July 8, 1958, illustrate pivoting frameworks with a strap to engage a tree, the entire arrangement being moved upwardly by pivoting free from the tree and shimming up the tree under hand power.

The combination of hand-held pole grippers and foot operated pole grippers is illustrated in U.S. Pat. No. 213,715 to Von Mengden, Mar. 25, 1879.

Additional constructions for tree stands and climbing arrangements are shown in U.S. Pat. No. 3,358,789 to Laun, Dec. 19, 1967 and No. 3,078,951 to Schneebeli et al, Feb. 26, 1963.

SUMMARY OF THE INVENTION

The upper hand-held small climbing device is shimmied up the tree and then pivoted downwardly until it grips the tree. The standing platform is then shimmied up the tree by lifting the body with the feet underneath of the foot straps on the platform. This pivots the platform away from the tree so that the strap may be slipped up into a new position. When the platform is then pressed against the tree, it will be held in place so that the upper hand-held climbing gripper may then be pivoted upward to release and shimmied up the tree also.

The stand and loop are provided with steel straps which can be easily set for different diameter trees. The strap of the tree stand is provided with pins to retard sawing.

The user's toes fit under a bar and are held in place by elastic heel straps which also facilitate backpacking of the stand.

The front edge of the stand is provided with a compound concave notch for addressing trees of various girths.

A seat is provided which has few parts and folds out of the way when not in use.

The principles of the invention will be further hereinafter discussed with reference to the drawings wherein a preferred embodiment is intended to exemplify, rather than limit, aspects of the invention as defined in the claims.

DETAILED DESCRIPTION OF THE PRESENTLY PREFERRED EMBODIMENT OF THE INVENTION

Figure 1:
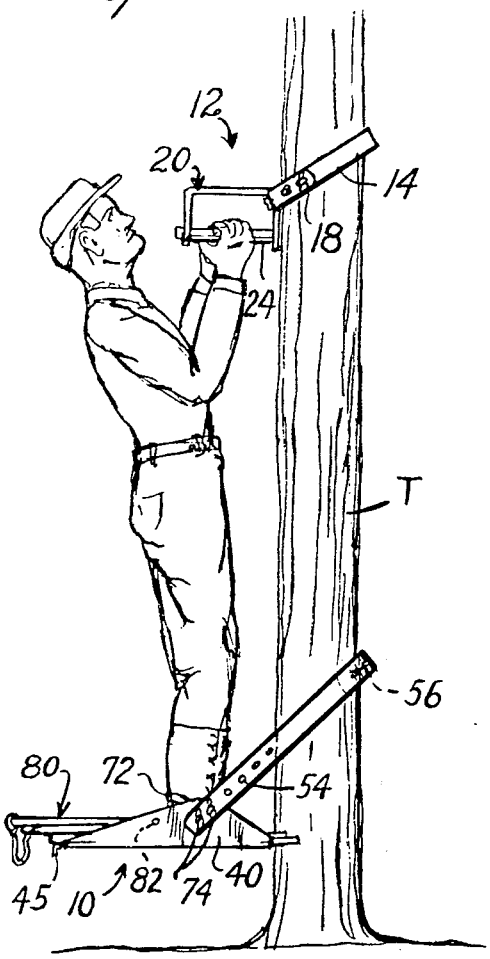
FIG. 1 is a side elevation view of the climbing tree stand and hand-operated climbing aid loop in use on a tree.

The equipment shown in the drawings includes a major item, the climbing tree stand 10, and an auxiliary item, the hand-operated climbing aid loop 12.

The loop 12 includes a flexible strap 14 which may be resiliently drawn into a convolute form so that any of the holes 16 provided therethrough near the opposite ends thereat are in registry for receipt of a fastener means 18, such as a bolt with a wing nut threaded thereon. The loop 12 further includes a handle 20 shown including a generally U-shaped yoke 22 with a bar 24 secured between the tree ends of the legs of the yoke 22. The U-shaped yoke 22 is of squared figure, and has one of its corners provided with a short oblique section 26, sized to cradle the strap 14 flatwise of a face of the strap. A fastener 28, such as a bolt with a wing nut threaded thereon, is provided through the handle yoke section 26 for securing the handle to the strap through any other pair of registered holes 16. By preference, the leg 30 of the yoke 22 extends below the bar 24 to increase the area of contact between the yoke and the front of the tree when the loop 12 is in the position shown in FIG. 1 and at the top (stage C) in FIG. 2.

Figure 2:
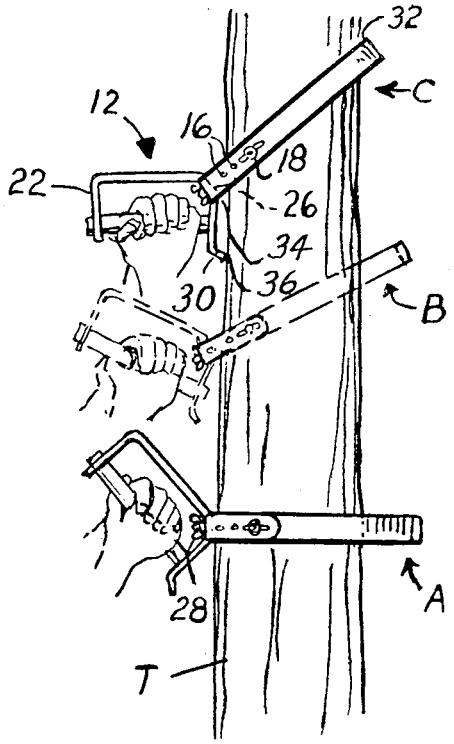
FIG. 2 is a "multiple exposure" side elevation view of the loop, showing three stages of its use.

In use, the loop strap 14 is adjusted in size about a tree trunk T so that its girth is larger than that of the tree trunk T by, for instance, the amount shown in FIG. 2, stage A, wherein the strap loops about the tree are in a generally level condition. Then the loop is cocked as progressively shown in stages B and C of FIG. 2, to fully fill the looped strap with the tree trunk, so that the strap bites the tree trunk at 32, 34, the yoke bites the tree trunk below the bar 24 at 36 and the bar 24 projects generally radially outwardly, horizontally from the tree trunk. When the climbing aid loop 12 is positioned as shown in FIG. 1 and in stage C of FIG. 2, the climber may grasp the bar 24 by hand and pull upwards to raise himself.

The climbing tree stand includes a generally rectangular platform 38 with upstanding wings 40 at each side. A typical size for the platform 38 is 19 inches wide by 24 inches from front to rear, at the side edges. As shown, the platform floor 38 is made of plywood, with the wings 40 being formed as angle members with horizontal webs 42 underlying the side edges of the platform floor and secured thereto at 44. However, the platform floor and wings could be formed as an integral part, e.g. made from fiber reinforced plastic, with reinforcements and metallic bushings for the openings which are illustrated. Even when the platform 38 is made of wood, it may be advantageously reinforced with, e.g. one or more metal channels extending thereacross as suggested at 45. The apices 46 of the wings 40 are shown being disposed about one-third the distance from the front edge of the platform.

Near each apex 46, a pair of holes 48, 50 is provided through each wing. The holes 50 are positioned above and forwardly of the holes 48, approximately on a 45° line with respect to the plane of the platform floor 38.

The stand 10 also includes a flexible strap 52, preferably made of blued steel. It has a series of holes 54 through the thickness thereof near each end, but differs from the strap 14 by the added provision of a plurality of prongs 56 projecting from one face 58 thereof midway along the strap 52.

The front edge of the platform 38 is provided with a compound V-notch including a central portion 60 of a smaller included angle and two flanking segments 62 which constitute a flanking portion of a larger included angle. When the platform is made of a material of moderate durability, such as plyboard, that leading edge, or at least the areas of most wear are advantageously provided with wear plates 64 made of steel plate or the like.

Figure 4:
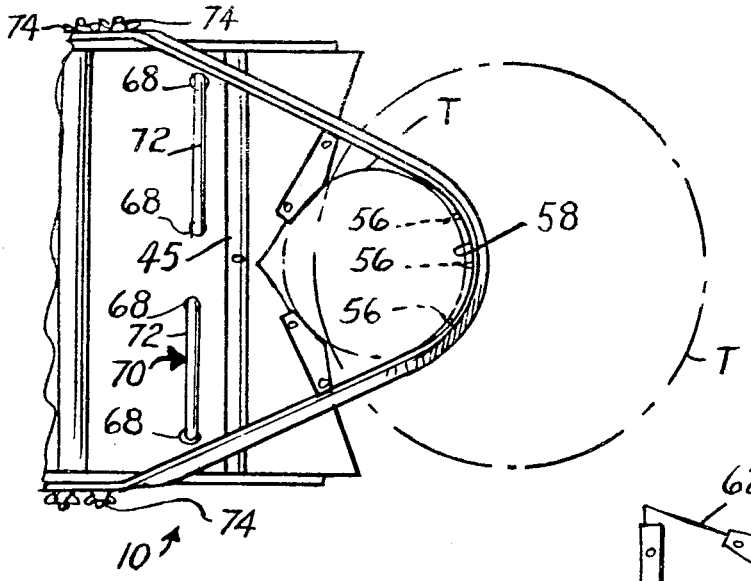
FIG. 4 is a diagrammatic top plan view of the climbing tree stand in position against two sizes of tree.

With reference to FIG. 4, when the platform confronts a tree of small diameter, the tree may nest in the central portion 60 of the platform's leading edge, and when the platform confronts a tree of larger diameter, the tree may nest in the flanking portion 62 of the platform's leading edge.

Figure 3:
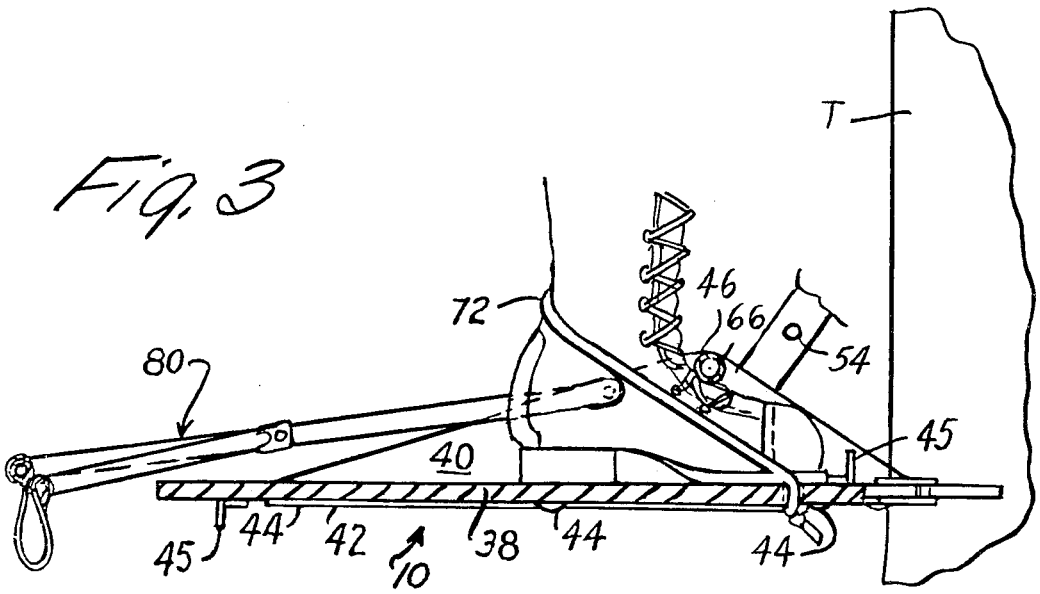
FIG. 3 is a longitudinal sectional view of the climbing tree stand, with the folding seat removed.
Figure 5:
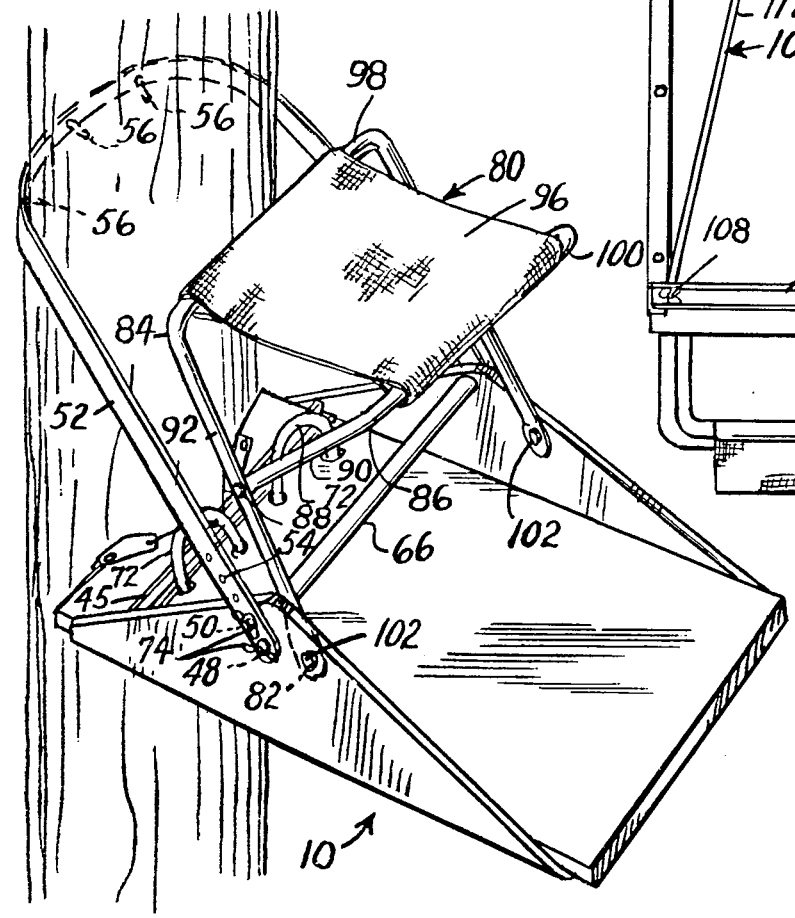
FIG. 5 is a perspective view of the climbing tree stand, with the folding stand erected and open for seating.

Referring to FIGS. 3 and 5, the wings mount the ends of a horizontal lift bar 66, positioned above the platform floor near the apices 46 at a level which will permit the user to slide his toes thereunder until the bar engages his insteps. Four transversely spaced holes 68 provided through the platform floor, e.g., slightly forwardly of the position of the bar 66, permit an elastic shock cord or the like 70 (FIGS. 3 and 6) to be looped over and under the platform floor and knotted to provide two heel loops 72. Accordingly, when the user shoves his feet under the bar 66, he may pull the loops 72 around back of his heels to keep his feet securely in the position shown in FIG. 3.

In use, the loop strap 52 is positioned so that two holes 54 near one end align with the holes 48, 50 on one wing and fasteners 74 such as wing nuts and bolts are assembled therethrough. The strap 52 is looped about the tree trunk T so that the prongs 56 are on the inner side of the loop. The corresponding two holes 54 near the opposite end of the strap are aligned with the holes 48, 50 on the other wing and similar fasteners 74 assembled therethrough. As depicted in FIGS. 1 and 5, the strap 52 thus proceeds upwardly and forwardly at about a 45° angle from the respective wings and the prongs 56 are positioned to engage the tree trunk T at a set of points generally diametrically opposed from the platform.

As with the hand-operated climbing aid loop 12, the loop strap 52 is so assembled with respect to the wings 40, by choice of which holes 54 are aligned with the holes 48, 50, that when the platform is tilted up toward the tree (a position not shown) to make the loop strap 52 more horizontal, its girth (including the front edge of the platform) is larger than that of the tree trunk, by such an amount that the climbing tree stand 10 may be slipped up the tree trunk T. When the stand 10 has achieved the desired raised location, it may be tipped again to level the platform 38. As a consequence, the loop strap 52 hugs the tree and the prongs 56 dig in to reduce lateral tipping or shifting of the platform as the user shifts his weight around thereon.

The hand-operated loop 12 is used in conjunction with the stand 10 as follows. Both are assembled about the tree trunk as explained above. The user then steps on the stand and secures his feet in place as shown in FIG. 3. The hand-operated loop 12 is worked up the tree as successively shown in the three stages of FIG. 2. Then the user hangs from the bar of the hand-operated loop 12, bends his knees to tip the rear of the platform 38 up and thus loosens the loop strap 52 with respect to the tree trunk T, and lifts his feet to raise the stand 10. The user then uses his ankles to bring the stand to a flat condition, thus locking the platform against the tree again, but at a higher level. The operations of raising the loop 12 and stand 10 are alternated until the user has achieved the desired height. Some knee flexing and ankle straightening performed when the stand has reached about the desired level can be used to eliminate undesired tilting or cocking of the platform.

Now the user is free to let loose of the loop 12 and to take his feet out of the heel straps and from under the raising bar.

Lowering the apparatus is similarly accomplished although it is in practice a little more difficult. The feet are positioned again as shown in FIG. 3, the hand-operated loop 12 is worked down the tree in a reversal of the stages depicted in FIG. 2 and the user goes into a half-squat while holding the bar of the loop 12 to loosen the stand 10 from the tree trunk. After letting the stand 10 slide down the tree trunk to a new, lower position, the user brings the platform 38 back to a flat condition with his feet and ankles, being sure the stand 10 is again locked to the tree before turning loose of the loop 12. These steps are repeated until the ground is reached.

Of course, the stand 10 may be used without the loop 12, by hugging the tree trunk with one's arms, instead.

Figure 6:
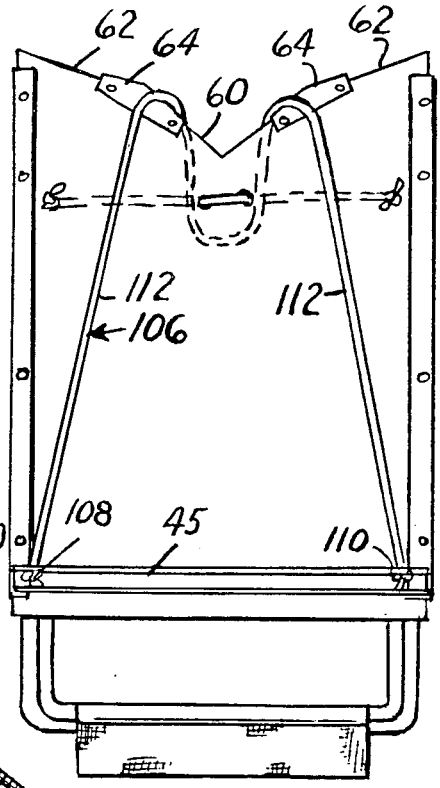
FIG. 6 is a front elevation view of the tree climbing stand folded and provided with shoulder loop strap means for back-packing the stand.

A very useful accessory part of the stand 10 is shown in FIGS. 1, 5 and 6. That is the folding seat 80.

It should now be noticed that the wings 40 are provided with an additional pair of holes 82 located about midway between the front and rear edges of the platform 38. The folding seat 80 is shown including a first, longer legged U-shaped frame 84, a second shorter legged U-shaped frame 86, fastener means 88 pivotally securing the free ends of the legs 90 of the shorter frame 86 to intermediate locations on the corresponding legs 92 of the longer frame. A flexible saddle 96 of canvas or the like is secured between the horizontal bars 98, 100 of the two frames 84, 86 and the free ends of the legs 92 of the longer frame are pivotally secured to the wings 40 by installing fasteners 102 through the holes 82.

As best shown in FIG. 2, the geometry of the stand and seat are such that when the stand has been raised to the level where the user expects to stay for a while, the seat 80 may be erected by pivoting the longer frame 84 about the fasteners 102 until the bar 98 rests against the tree trunk T, then pivoting the shorter frame 86 about the fasteners 94 until the seat is unfolded for seating as depicted in FIG. 5. The user may then sit thereon and look from side to side. When the user wishes to stand, the backs of his legs may be used to pivot the shorter frame 86 back about the fasteners 94 until the bar 100 is against the tree trunk T. This places the seat out of the way without need for any use of the user's hands. When the stand 10 is being raised and lowered on the tree trunk, the seat may be pivoted out of the way in the opposite direction, as shown in FIGS. 1 and 6, in which case the longer frame 84 is pivoted about the fasteners 102 until the legs 92 lie on the side edges of the platform 38 where the wings 40 adjoin the platform. The legs 92 are long enough that when the seat is folded in this sense, the saddle 96 and bars 98, 100 lie off the back end of the platform and do not represent an obstruction.

The stand 10 may be back packed as shown in FIG. 6, by securing, e.g. a shock cord 106 to the platform reinforcing 45 at one end 108 on the bottom side of the platform, and stringing that cord up over the front edge of the platform, down through one foot loop on the normally upper surface of the platform, up through the other foot loop, back onto the bottom side of the platform and down to a securement at 110 at the opposite end of the reinforcement 45. The user's arms may then be inserted through the long loops at 112 for carrying the stand 10.

It should now be apparent that the tree climbing stand as described hereinabove possesses each of the attributes set forth in the specification under the heading "Summary of the Invention" hereinbefore. Because the tree climbing stand of the invention can be modified to some extent without departing from the principles of the invention as they have been outlined and explained in this specification, the present invention should be understood as encompassing all modifications as are within the spirit and scope of the following claims.

What is claimed is:

1. Tree climbing equipment, comprising:

a stand, including a generally rectangular platform having upstanding wing means at the sides thereof and a generally concavely V-shaped front edge for confronting a tree trunk;

a flexible strap having a plurality of prongs projecting from one face thereof midway along the length thereof for biting into a tree trunk;

means defining fasteners associated with the wing means and with the flexible strap, near the opposite ends of the strap for securing the strap, near the opposite ends thereof, to the wing means so that the strap loops from one wing means forwardly and upwardly to the vicinity of the prongs, then downwardly and rearwardly to the other wings means, the fasteners being adjustable to vary the girth of the loop defined by the strap and by the front edge of the platform, so that the girth may be adjusted to permit the stand to be slipped upwards or downwards on a tree trunk encircled by the loop while the loop is generally horizontal and the platform rear is tipped up, but will hug the tree trunk and have the prongs bite thereinto when the platform is leveled and the loop is consequently tipped;

binding means for securing a user's feet to the stand, whereby the user may raise, lower, tilt and level the stand by reacting his feet thereagainst;

the binding means being constituted by a rigid bar extending transversely between the two wing means at such spacing above the platform as to be positioned to engage the insteps of the user's feet when the user's toes are slid thereunder; and two elastic cord loops on the platform, positioned to resiliently bracket the user's heels in a sense to hold the user's insteps against the bar, so that as the user lifts upwardly with his feet, his feet pull the stand upwardly by applying force to the rigid bar.

2. The tree climbing equipment of claim 1 wherein the flexible strap is made of steel.

3. The tree climbing equipment of claim 1 wherein the fasteners are constituted by means defining a pair of holes through each wing means, one hole of each pair being forwardly and higher than the other on an approximately 45° line;

means defining a series of longitudinally spaced holes through the strap near each end thereof; and nut and bolt means assembled through both holes of each pair of holes through the wing means, and a respective two holes of each said series through the strap.

4. The tree climbing equipment of claim 1 wherein the platform V-shaped front edge has a compound shape including a central section of lesser included angle, and two flanking portions which jointly define a flanking section of larger included angle, whereby the platform is designed to confront tree trunks of both smaller diameter and larger diameter.

5. Tree climbing equipment comprising:

a stand, including a generally rectangular platform having upstanding wing means at the sides thereof and a generally concavely V-shaped front edge for confronting a tree trunk;

a flexible strap having a plurality of prongs projecting from one face thereof midway along the length thereof for biting into a tree trunk;

means defining fasteners associated with the wing means and with the flexible strap, near the opposite ends of the strap for securing the strap, near the opposite site ends thereof, to the wing means so that the strap loops from one wing means forwardly and upwardly to the vicinity of the prongs, then downwardly and rearwardly to the other wing means, the fasteners being adjustable to vary the girth of the loop defined by the strap and by the front edge of the platform, so that the girth may be adjusted to permit the stand to be slipped upwards or downwards on a tree trunk encircled by the loop while the loop is generally horizontal and the platform rear is tipped up, but will hug the tree trunk and have the prongs bite thereinto when the platform is leveled and the loop is consequently tipped;

binding means for securing a user's feet to the stand, whereby the user may raise, lower, tilt and level the stand by reacting his feet thereagainst;

a folding seat pivotally mounted on said wings for pivotal movement between a first position wherein the seat is collapsed and leaves the platform substantially unobstructed thereby and an erected position wherein the seat is disposed to lean against the tree trunk so the user may sit on the seat and lean against the tree trunk; the folding seat including:

a first, longer U-shaped frame having two legs joined to a central bar, and having the free ends of the legs thereof pivoted to the respective wings approximately midway along the platform, the legs being sufficiently long that when the longer frame is pivoted rearwardly until the legs lie adjacent the platform beside the wing means, the central bar lies adjacent the rear edge of the platform;

a second, shorter U-shaped frame having two legs joined to a central bar; having the free ends of the legs thereof pivotally secured to the respective legs of the longer frame intermediate the lengths of the legs of the longer frame; and a flexible saddle secured between the two central bars, whereby the user, when seated, may stand and push the backs of his legs against the central bar of the shorter frame to fold the seat against the tree trunk to leave the platform substantially unobstructed.

6. The tree climbing equipment of claim 5 wherein the binding means is constituted by a rigid bar extending transversely between the two wing means at such spacing above the platform as to be positioned to engage the insteps of the user's feet when the user's toes are slid thereunder; and two elastic cord loops on the platform, positioned to resiliently bracket the user's heels in a sense to hold the user's insteps against the bar, so that as the user lifts upwardly with his feet, his feet pull the stand upwardly by applying force to the rigid bar;

and equipped for back-packing by having cord means extending from securement near one bottom rear corner of the platform, forwardly across the bottom, across the front edge and down through one of said elastic cord loops, up through the other of said elastic cord loops, back across the front edge and rearwardly across the bottom to another securement near the opposite bottom rear corner of the platform.

7. Tree climbing equipment, comprising:

a stand, including a generally rectangular platform having upstanding wing means at the sides thereof and a generally concavely V-shaped front edge for confronting a tree trunk;

a flexible strap having a plurality of prongs projecting from one face thereof midway along the length thereof for biting into a tree trunk;

means defining fasteners associated with the wing means and with the flexible strap, near the opposite ends of the strap for securing the strap, near the opposite ends thereof, to the wing means so that the strap loops from one wing means forwardly and upwardly to the vicinity of the prongs, then downwardly and rearwardly to the other wing means, the fasteners being adjustable to vary the girth of the loop defined by the strap and by the front edge of the platform, so that the girth may be adjusted to permit the stand to be slipped upwards or downwards on a tree trunk encircled by the loop while the loop is generally horizontal and the platform rear is tipped up, but will hug the tree trunk and have the prongs bite thereinto when the platform is leveled and the loop is consequently tipped;

binding means for securing a user's feet to the stand, whereby the user may raise, lower, tilt and level the stand by reacting his feet thereagainst; and a hand-operated climbing-aid loop comprising:

a flexible strap having a series of longitudinally spaced holes therethrough near each end thereof, whereby the strap may be resiliently formed into a loop of variable girth so as to align at least some of the holes of each series with one another, fastener means inserted through two aligned holes of said series;

a handle; and fastener means securing the handle to the strap through another two aligned holes of said series, the handle including a hanging bar having such an attitude that when the flexible strap of the climbing aid loop encircles the tree trunk on which the stand is being used, when the platform of the stand is level, the hanging bar radiates outwards from the tree trunk generally horizontally, so the user may grasp it, flex his knees and point his toes down to tip the stand platform with respect to the tree trunk so the stand may be raised or lowered, then resecured to the tree trunk.

* * * * *